US005169019A

United States Patent [19]

Büdenbender

[11] Patent Number: 5,169,019

[45] Date of Patent: Dec. 8, 1992

[54] INTERNALLY LINED BUNG-TYPE CONTAINER

[76] Inventor: Bernd Büdenbender, Schubertweg 5, 2160 Stade, Fed. Rep. of Germany

[21] Appl. No.: 668,270

[22] Filed: Mar. 11, 1991

[30] Foreign Application Priority Data

Mar. 11, 1990 [DE] Fed. Rep. of Germany ..... 4007617

[51] Int. Cl.[5] ..... B65D 25/20

[52] U.S. Cl. ..... 220/404; 220/465

[58] Field of Search ..... 220/403, 404, 465, 466, 220/470

[56] References Cited

U.S. PATENT DOCUMENTS

| | | | |
|---|---|---|---|
| 2,245,430 | 6/1941 | Courtright et al. | 220/466 X |
| 2,338,604 | 1/1944 | Silveyra | 220/403 X |
| 2,721,674 | 10/1955 | Lazard | 220/466 X |
| 2,987,216 | 6/1961 | Fletcher | 220/404 X |
| 3,167,210 | 1/1965 | Carney, Jr. | 220/404 X |
| 3,377,766 | 4/1968 | Nelson | 220/403 X |
| 3,432,069 | 3/1969 | Craig | 220/465 X |
| 3,432,070 | 3/1969 | Carpenter, Jr. et al. | 220/465 X |
| 4,164,304 | 8/1979 | Roberson | 220/465 |
| 4,635,814 | 1/1987 | Jones | 220/403 |
| 5,046,634 | 9/1991 | McFarlin et al. | 220/465 |

*Primary Examiner*—Steven M. Pollard
*Attorney, Agent, or Firm*—Herbert Dubno

[57] ABSTRACT

A bung-type drum or barrel has an internal liner formed by a removable insert container which can be introduced through one of the bung openings and has tubular formations of the synthetic resin foil which can be held in or drawn into the bung openings and there can be held by retaining elements. The liner conforms to the interior of the drum and, for the removal of residues, can be withdrawn through a bunghole and replaced.

6 Claims, 2 Drawing Sheets

INTERNALLY LINED BUNG-TYPE CONTAINER

FIELD OF THE INVENTION

My present invention relates to an internally lined bung-type container and especially a barrel o drum for the storage, transportation or delivery of flowable materials. When reference is made herein to a drum it will be understood that this term is also intended to include barrels provided with a bung and, conversely, when reference is made to a barrel having a bung, it will be understood that this reference also includes drums.

BACKGROUND OF THE INVENTION

Containers provided with bungs, namely bung-type barrels and drums, are customarily made from sheet steel and can be used for the transportation or storage of a wide variety of solid and liquid materials which may be flowable to enable them to be introduced into or discharged from the drum through the opening provided when the bung is unstoppered. In many cases, the steel sheet forming the container must be protected against corrosion by water or other aggressive corrosive materials which may be introduced into the container by a suitable internal coating. Bung-type drums which are internally lacquered are frequently used for this purpose although internal coatings of other materials which are more resistant to aggressive and corrosive substances than conventional lacquer may also be employed.

While in some cases the drum or barrel is destroyed after use by compaction or scrapping, it is frequently required to reuse the barrel or drum for the transport and/or storage of, for instance, another substance. In such cases, not only is it necessary to free the barrel or drum from all residues of the substance previously transported and thus to empty the container as fully and completely as possible, but it also is required to clean the interior of the container before introducing the new substance.

For water soluble substances it generally suffices to rinse the interior of the barrel or drum with water. A problem with this, of course, is that the rinsing water must be discharged and frequently is contaminated so that it might pose an environmental hazard. With substances that are not as readily soluble, the cleaning can be effected with hot water to which detergents or other cleaning agents can be added. There are, however, substances requiring transportation and storage in drums or barrels whose residues cannot be readily removed in either of the aforedescribed ways so that intensive cleaning is required. The intensive cleaning generally involves a high degree of heating of the barrel or drum to the point that sealing materials which may be incorporated in the folds or bung structure of the barrel may decompose or so deteriorate that the barrel or drum becomes useless. Furthermore, the heating must be carried out in relatively expensive units, for example, furnaces, ovens or the like.

It has been suggested to cover the interiors of containers with foils. These systems also require cleaning and frequently heating so that the foils may be destroyed or damaged like the sealing compositions and sealing rings as described previously. As a consequence, cleaning processes are not desirable when such foil linings are used. Finally, when washing liquids are employed it frequently is found that they introduce problems and promote damage to the linings and seals of the barrel or drum during heating.

OBJECTS OF THE INVENTION

It is the principal object of the present invention, therefore, to provide a bung-type container, i.e. a drum or barrel, which can be reused without the considerable expense of cleaning processes which may be inhibited by small-diameter bung openings and yet can ensure absolute freedom from contamination of the newly introduced filling material by residues of substances previously contained in the barrel or drum.

Another object of the invention is to provide an improved drum having at least one bung opening which is free from the drawbacks outlined above.

Still another object of the invention is to provide a low cost reusable container which can be readily prepared for reuse.

SUMMARY OF THE INVENTION

These objects and others which will become apparent hereinafter are attained, in accordance with the invention in a drum which comprises:

a generally cylindrical drum body having a bottom and a top formed thereon, the top being formed with at least two bungs;

a replaceable container-forming liner of flexible material insertable into the drum body through one of the bungs and being formed with a liner body configured to lie along an interior of the drum body and along the bottom and top substantially without stretching stress, the liner having a top portion formed with respective upwardly extending flexible tubular formations dimensioned to fit into and line the respective bungs; and respective retaining elements received in the bungs for sealingly and removably affixing each of the tubular formations in the respective bung.

Thus the lining is formed by a unitary insertable container which, in its dimensions and configuration, conforms to the internal dimensions and configuration and which is the only portion of the barrel or drum to contact the flowable substance introduced into the latter through a bung and, therefore, the tubular formation lining same. After use, this insertable container can be completely removed and replaced by a new insertable container, also through a bung. The disposal of the used lining is relatively simple and only residues which remain adherent to it require disposal with the used lining. The introduction of the new insert, completely free from any contaminants, provides an absolutely reliable relining of the drum or barrel so that contamination of a subsequent product by the former product need not be feared.

According to a feature of the invention, the replaceable container-forming liner is composed of a flexible synthetic resin foil which can be gathered, folded or bunched, for insertion thereof into the drum body through one of the bungs. Preferably, the retaining elements define internal screwthreads which are engaged by externally threaded stopper plugs threaded into the bungs and these retaining elements. The stopper plugs can, where appropriate, brace the retaining elements outwardly against the tubular formations of the synthetic resin foil liner anchoring them against the walls of the bung and ensuring sealing between the liner and the bung walls.

The retaining elements may be spring rings having inwardly bent ends which can be drawn together to reduce the diameter of the spring ring to less than the internal diameter of the respective bung and enable insertion of the spring ring into the bung, the spring ring spreading within the respective bung to retain the tubular formation thereagainst. The retaining elements may be helical springs pressing outwardly upon a respective tubular formation to deform the same into helical recesses formed in inner surfaces of the bungs. The helical spring can thus define the internal screwthread which has the pitch and thread configuration of a stopper plug threaded into the bung.

Alternatively, the retaining elements can be internally threaded inserts and the exterior of the insert and interior of the bung receiving same can be provided with mutually engaging means limiting displacement of the insert in the bung. The mutually engaging means can include a groove and a groove and a projection engaging in said groove. The groove is preferably formed on the insert and the projection on the bung. The groove can be an axial groove or can form a bayonet connection with the projection.

Each of the tubular formations can be provided with a loop or bail enabling the formation to be engaged by a wire or hook to permit the tubular formation to be drawn upwardly into the respective bung or to be retained as the gathered insert is spread, e.g. by air or the flowable substance which is to be introduced into the drum. The formations may further have a pair of strips extending from the free ends thereof which ca overhang the bung and thus are readily accessible when the plug is removed to enable the used insert to be pulled from the barrel or drum. To facilitate use of a container like insert as the liner, according to the invention, relatively large diameter bungs are employed, e.g. two inch bungs.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figure 1:
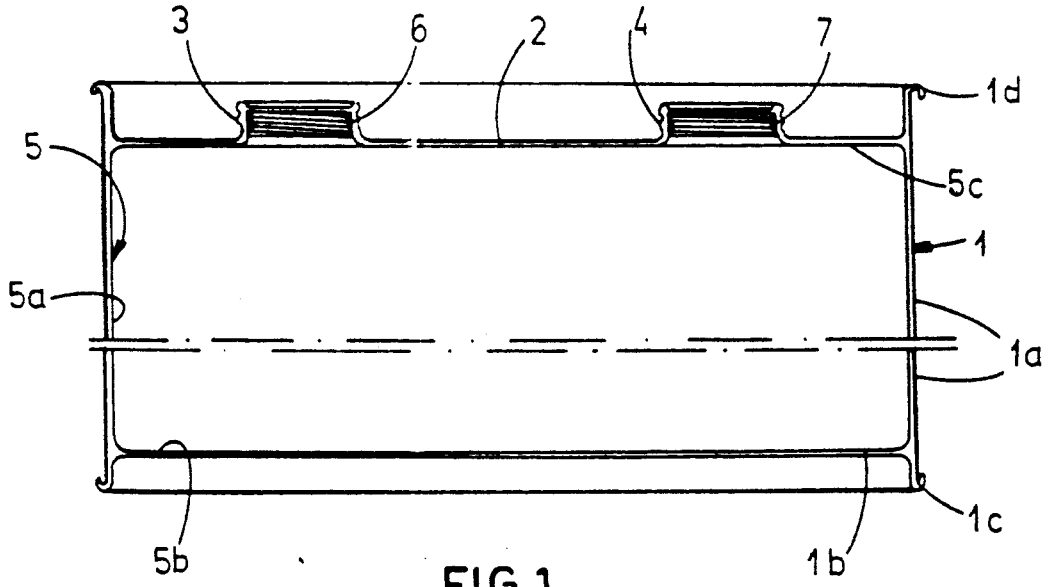
FIG. 1 is a diagrammatic cross section view which is broken and schematically illustrates a drum provided with bungs and having a container like insert forming a liner according to the invention.

FIG. I shows a container I in stylized form with the body thereof broken between the top and bottom of that container and in the form of a drum having two bungs 3 and 4 formed at the upper end. To maintain some semblance of proportion, the parts shown in FIG. 1 have been illustrated without wall thickness because, compared to other dimensions of the drum, the wall thickness of the insert and of the sheet metal of the drum would be vanishingly small.

Figure 4:
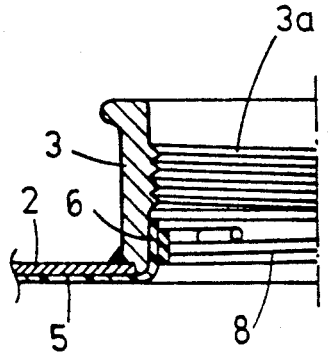
FIG. 4 is an axial section through a bung showing the spring ring clamping the tubular formation of a container-like insertable liner against an inner wall of the bung.
Figure 5:
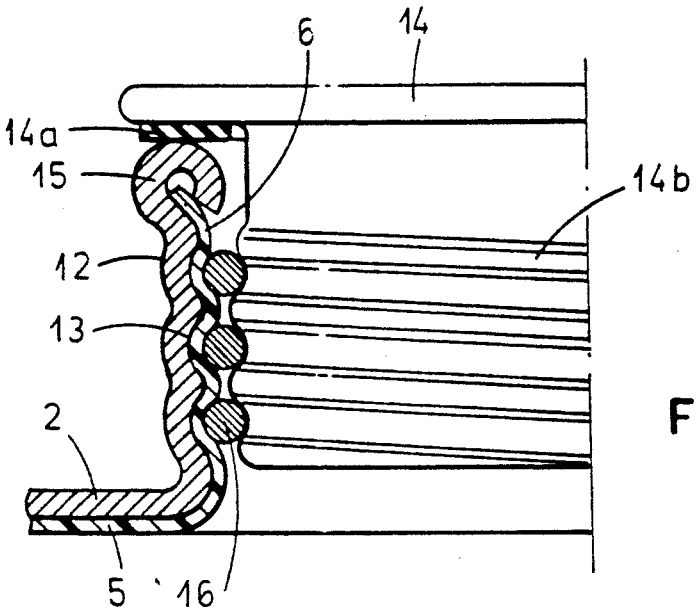
FIG. 5 is an axial cross sectional view of a bung which is pressed from the sheet material of the top of the drum, has a helical recess profile and shows the relationship of threaded stopper plug with a helical retaining element and the liner.
Figure 6:
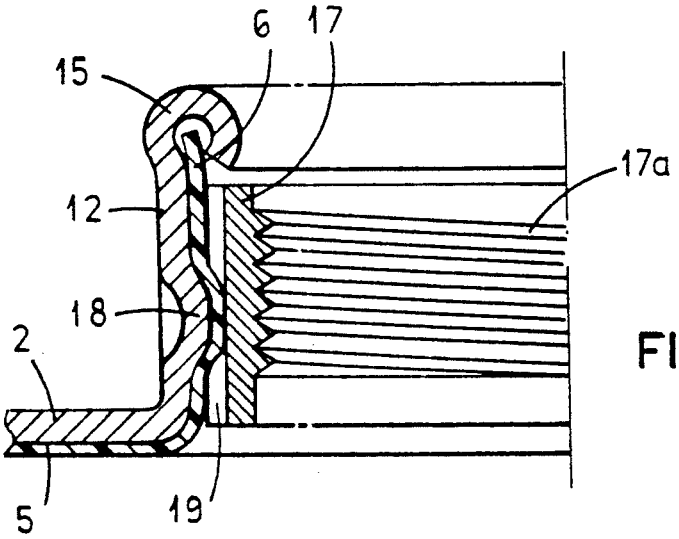
FIG. 6 is a cross section view similar to FIG. 5 illustrating the use of an internally threaded retaining element.
Figure 7:
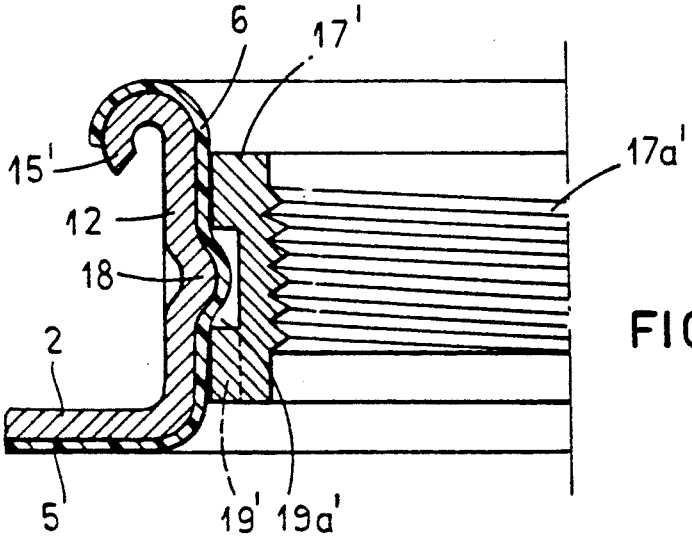
FIG. 7 is another view similar to FIG. 5 illustrating an internally threaded retaining element forming a bayonet connection with the bung.

The bung 1 comprises a body 1*a* which is generally of cylindrical configuration and can have, formed thereon, if desired, vertically spaced circumferential corrugations. The bottom 1*b* of the drum may be connected with the body 1*a* by a rolled rim 1*c* which is conventional in the art. The top 2 of the drum may also be connected with the body 1*a* by a rolled rim i*d* and the bungs 3 and 4 may comprise cylindrical fittings welded to the top 2 as has been shown in FIG. 4, but preferably is formed from the material of the top unitarily as is illustrated in the embodiments of FIGS. 5 through 7.

The body, top and bottom of the drum 1 are lined with an insertable container 5 which can be composed of a synthetic resin foil and which, in turn, has a cylindrical portion 5*a* adapted to line the generally cylindrical body 1*a*, a bottom 5*b* unitary with the cylindrical portion 5*a* and adapted to line the bottom 1*b* and a top portion 5*c* which is designed to underline the top 2 of the drum so that over the entire interior of the drum, the lining or inserted container 5 can lie against and can be supported by the walls of the drum without the application of any stress or strain to the foil material of the lining. The lining thus conforms fully to all of the dimensions and contours of the interior of the drum.

To facilitate the insertion and mixing of the insert container 5 in the drum 1, the bungs 3 and 4 are both of the larger of the usual bung diameters, namely, two inch diameter bungs.

The insert container 5 can be composed of synthetic resin foil which can be blowmolded, injection molded or ultrasonically or thermally welded together from foil parts, or cemented together from foil parts.

In any case, for a generally cylindrical drum constituting the outer container, the insert container will have a corresponding cylindrical form with a cylindrical body and two circular members forming the top and bottom corresponding to the end closures of the container 1.

At locations of the top 2 corresponding to the buns 3 and 4, the upper portion 5*c* of the insert body is provided with tubular formations which can have an outer diameter equal to the inner diameter of the bungs. These tubular formations, after insertion of the insert container 5 in a gathered or folded form into the container 1 through one of these bungs, can be fixed in the bung opening or drawn up into the bung opening and sealingly held therein.

For insertion of the insert container 5, it can be rolled up, folded or otherwise gathered and fed through one of the bung openings, preferably in such manner that one of the tubular formations will be held in this bung opening. The remainder of the liner 5 will unfold within the container 1 and can spread out within the interior thereof by blowing air into the liner through the tubular formation 6 which may be held in the bung opening 3 for example. The other tubular formation 7 can then be drawn into the other bung opening.

Figure 2:
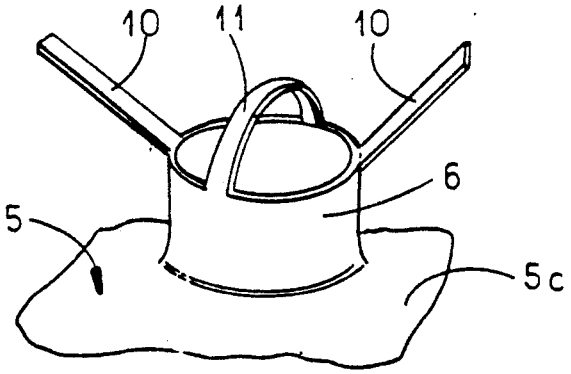
FIG. 2 is a fragmentary perspective view greatly enlarged in scale with respect to FIG. 1 showing one of the tubular formations and the loop strips thereof.

For this purpose (see FIG. 2) each of the tubular formations may be provided with an integral loop or bail 11 which allows retention of a tubular formation in a bung opening or the catching of a tubular formation within the drum so that it can be drawn into the other bung opening using a hook provided at the end of a wire inserted through the opening of the bung 4 for example.

The expansion of the liner within the drum can also be effected with the fluid substance to be transported or stored therein and which can be filled into the drum through the tubular formation held in its bung opening.

After the contents of the drum have been discharged, removal of all traces of that substance can be achieved by simply releasing one of the tubular formations from its bung, allowing it to fall into the drum. The liner is then pulled out of the drum utilizing the other tubular formation through the other bung. The manipulation of the tubular formations 6 and 7 is facilitated when both are provided with loops or bails 11 and when, in addition, synthetic resin strips 10 are provided on the tubular formations to enable gripping and pulling thereof as required.

Figure 3:
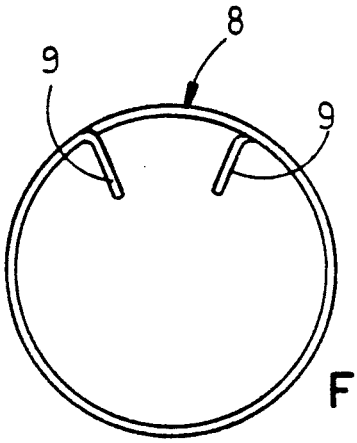
FIG. 3 is a plan view of a spring ring forming a retaining element according to the invention.

As noted, once the tubular formations are properly located within the bungs 3 and 4, they are fixed in place by retaining elements. In FIG. 3 I have shown a relatively simple retaining element in the form of a spring ring 8 composed of a noncorroding wire, for example, a stainless steel wire in the form of a helix having more than one turn and whose turns can, if desired, form an internal screwthread as will be describe with respect to the embodiment of FIG. 5. Here, however, the bung 3 is provided with an internal screwthread 3*a* above the spring ring 8 and serving to engage the external screwthread of a stopper which can close the bung. The spring ring 8 thus has the configuration of a coil tension spring which in its relaxed condition as shown in FIG. 3, has a greater outer diameter than the inner diameter of its seat within the bung.

To reduce the diameter of this spring ring and enable it to be inserted into the bung, the two ends of the wire which is coiled to form the ring spring are inwardly bent to shanks 9 which can be easily drawn together by the fingers of a user, thereby reducing the inner diameter of the spring ring, enabling its insertion into the bung and permitting release of the shanks 9 to cause expansion of the spring ring to press the tubular formation 6 or 7 against the inner wall of the bung 3 or 4.

For removal of a used liner, the user presses the shanks 9 together with his fingers or with a tool and removes the spring ring 8 from the bung, thereby releasing the tubular formation and withdrawal of the insert container in the manner described.

In FIG. 5 I have shown an embodiment in which the bung is formed from the sheet metal of the top 2 of the drum directly and has a tubular configuration as shown at 12 which can be stamped or drawn so that it has a helical recess 13 extending in a plurality of turns along the inner wall thereof. The pitch of this helical recess corresponds to the pitch of the external screwthread of the stopper plug 14. For easier manipulation, the end region of the tubular fitting 12 is rolled to form an end bead 15.

The tubular formation 6 of the liner 5 is first drawn into or held within the tubular fitting 12 and thereafter a helical spring 16 is inserted The turns of this spring press the foil tube 6 into the recess 13 and also project into the latter. The spring 16 then forms an internal screwthread into which the outer thread of stopper 14 can be screwed to close the bung. A seal 14*a* may be pressed against the bead 15. The external screwthread 14*b* of the stopper may have a cross section which is complementary to the cross section of the wire forming the spring 16.

The stopper 14 presses the spring 16 outwardly to form a firm seal of the spring against the foil tube 6 and the tube 12 in a radial direction and axial movement of the spring 16 is prevented by the penetration of the spring into the recess 13.

The inwardly rolled bead 15 can engage over the upper edge of the tubular formation 6 to provide additional retention of the latter. It is, however, also possible to roll over the upper edge of the tube 12 outwardly as shown at 15' in FIG. 7, whereby the tubular formation 6 can be drawn over the bead and can serve as an additional seal against the stopper 14.

In the embodiment of FIGS. 6 and 7, the tubular fitting 12 is also pressed from the material of the top of the drum. In these embodiments, however, the retaining element is an internally threaded member 17 or 17' whose internal screwthreads 17*a*, 17*a'* are engaged by the complementary threads of the respective stopper. The threaded inserts 17, 17' are dimensioned so that they can retain the tubular formations 6 against movement. An additional clamping effect, however, can be obtained when the threaded insert is conical at least over a segment of its length and is pressed over an annular zone of a correspondingly conical taper of the tubular fitting 12. With increasing displacement upwardly as the stopper is tightened, the fitting 17 or 17' can grip the tubular formation 6 against the conical portion of the tubular fitting 12 with increasing clamping force. In this case the clamping action is generated by the axial force component produced by tightening the stopper. It is also possible to provide the end bead 15 as an abutment against which the threaded insert 17 can be braced in its axial displacement.

A rotary entrainment of the threaded insert 17 or 17' during the engagement of the stopper therewith must be avoided and it is, therefore, possible to provide the tubular fitting 12 with a plurality of projections 18 which extend parallel to the axis of the tubular fitting and are equispaced about the axis. The threaded insert 17 can have correspondingly equispaced axially extending grooves 19 in which the projections 18 engage, the tubular formation 6 lying between these projections and the outer wall of the threaded insert 17. Axial displacement of the threaded insert 17 is possible until the latter abuts the inwardly turned bead 15, although angular displacement is prevented. The number of mutually engaging formations 18, 19, spaced apart around the axis of the bung can range between two and eight but is not limited to this range.

In FIG. 7 the axial groove 19' opens into a circumferential groove 19*a'* so that each projection 18 forms with the corresponding pair of grooves 19', 19*a'* a bayonet connection which limits both circumferential and axial displacement of the threaded insert 17'. The vertical groove or grooves permit the threaded insert 17 to be inserted into the bung and the limited angular movement can lock it therein. The locking can be enhanced by a narrowing of the groove or the bracing of the threaded insert 17 against an abutment surface of a fixed seat.

The end region of the groove extending circumferentially can also be undercut to prevent undesired loosening of the threaded insert.

Advantageously, the locking direction can correspond to the direction in which the stopper is rotated to tighten it against the bung thereby suppressing any tendency of the thread insert to release.

The described systems are not intended to limit the ways in which the tubular formation 6 or 7 can be secured in the bungs. They can be affixed in numerous ways so as to provide an appropriate and reliable seal. The seal can be free from mechanical tensile forces. In this manner the lining can be absolutely resistant to a wide variety of substances which can be introduced into the drum and the drum can be freed from all residues by replacement of the liner. The liners to be introduced into the drums can be stored in a gathered, folded or other highly compact form and likewise can be transported economically and simply. The removed used liner is likewise compact and is easily transported and disposed of.

I claim:

1. A drum, comprising:

a generally cylindrical drum body having a bottom and a top formed thereon, said top being formed with at least two bungs;

a replaceable container-forming liner of flexible material insertable into said drum body through one of said bungs and being formed with a liner body configured to lie along an interior of said drum body and along said bottom and top substantially without stretching stress, said liner having a top portion formed with respective upwardly extending flexible tubular formations dimensioned to fit into and line the respective bungs;

respective retaining elements received in said bungs for sealingly and removable affixing each of said tubular formations in the respective bung, at least one of said retaining elements being a helical spring pressing outwardly upon a respective one of said tubular formations and deforming same into a helical recess formed in an inner surface of the respective gung, said helical spring forming an internal screwthread of a pitch of an external screwthread of a stopper plug threaded into the bung and engaging said internal screwthread.

2. A drum, comprising:

a generally cylindrical drum body having a bottom and a top formed thereon, said top being formed with at least two bungs;

a replaceable container-forming liner of flexible material insertable into said drum body through one of said bungs and being formed with a liner body configured to lie along an interior of said drum body and along said bottom and top substantially without stretching stress, said liner having a top portion formed with respective upwardly extending flexible tubular formations dimensioned to fit into and line the respective bungs;

respective retaining elements received in said bungs for sealingly and removable affixing each of said tubular formations in the respective bung, at least one of said retaining elements being a helical spring pressing outwardly upon a respective one of said tubular formations and forming an internal screwthread of a pitch of an external screwthread of a stopper plug threaded into the bung and engaging said internal screwthread.

3. A drum, comprising:

a generally cylindrical drum body having a bottom and a top formed thereon, said top being formed with at least two bungs;

a replaceable container-forming liner of flexible material insertable into said drum body through one of said bungs and being formed with a liner body configured to lie along an interior of said drum body and along said bottom and top substantially without stretching stress, said liner having a top portion formed with respective upwardly extending flexible tubular formations dimensioned to fit into and line the respective bungs;

respective retaining elements received in said bungs for sealingly and removable affixing each of said tubular formations in the respective bung, each of said tubular formations being provided with a loop and holding strips at free ends thereof.

4. The drum defined in claim 3 wherein each of said bungs is a two-inch diameter bung.

5. A drum, comprising:

a generally cylindrical drum body having a bottom and a top formed thereon, said top being formed with at least two bungs;

a replaceable container-forming liner of flexible material insertable into said drum body through one of said bungs and being formed with a liner body configured to lie along an interior of said drum body and along said bottom and top substantially without stretching stress, said liner having a top portion formed with respective upwardly extending flexible tubular formations dimensioned to fit into and lien the respective bungs;

respective retaining elements received in said bungs for sealingly and removable affixing each of said tubular formations in the respective bung, said replaceable container-forming liner being composed of a flexible synthetic resin foil which can be gathered for insertion thereof into said drum body through said one of said bungs, said retaining elements defining internal screwthreads; and externally threaded stopper plugs threaded into said bungs and threadedly engaging said retaining elements, said retaining elements being braced outwardly against said tubular formations for anchoring same against said bungs, one of said retaining elements being a helical spring pressing outwardly upon a respective one of said tubular formations and deforming same into a helical recess formed in an inner surface of the respective bung, said helical spring forming an internal screwthread of a pitch of an external screwthread of a stopper plug threaded into the bung and engaging said internal screwthread.

6. A drum, comprising:

a generally cylindrical drum body having a bottom and a top formed thereon, said top being formed with at least two bungs;

a replaceable container-forming liner of flexible material insertable into said drum body through one of said bungs and being formed with a liner body configured to lie along an interior of said drum body and along said bottom and top substantially without stretching stress, said liner having a top portion formed with respective upwardly extending flexible tubular formations dimensioned to fit into and line the respective bungs;

respective retaining elements received in said bungs for sealingly and removable affixing each of said tubular formations in the respective bung, said replaceable container-forming liner being composed of a flexible synthetic resin foil which can be gathered for insertion thereof into said drum body through said one of said bungs, said retaining elements defining internal screwthreads; and externally threaded stopper plugs threaded into said bungs and threadedly engaging said retaining elements, said retaining elements being braced outwardly against said tubular formations or anchoring same against said bungs, each of said tubular formations being provided with a loop and holding strips at free ends thereof.

* * * * *